US006834701B2

(12) United States Patent
Colson et al.

(10) Patent No.: US 6,834,701 B2
(45) Date of Patent: Dec. 28, 2004

(54) BOTTOM-UP/TOP-DOWN RETRACTABLE CELLULAR SHADE

(75) Inventors: Wendell B. Colson, Weston, MA (US); Michael S. Goldberg, Longmont, CO (US); Terrenec M. Drew, Superior, CO (US); Paul F. Josephson, Longmont, CO (US); Ralph G. Jelic, Boulder, CO (US); Stephen P. Smith, Denver, CO (US)

(73) Assignee: Hunter Douglas Inc., Upper Saddle River, NJ (US)

( * ) Notice: Subject to any disclaimer, the term of this patent is extended or adjusted under 35 U.S.C. 154(b) by 84 days.

(21) Appl. No.: 10/393,698

(22) Filed: Mar. 18, 2003

(65) Prior Publication Data

US 2004/0020608 A1 Feb. 5, 2004

Related U.S. Application Data

(60) Provisional application No. 60/366,286, filed on Mar. 20, 2002.

(51) Int. Cl.[7] ..... E06B 9/08

(52) U.S. Cl. ..... 160/121.1; 160/245

(58) Field of Search ..... 160/121.1, 243, 160/245, 252, 253, 254, 167 R, 84.03

(56) References Cited

U.S. PATENT DOCUMENTS

| | | | | |
|---|---|---|---|---|
| 13,482 A | | 8/1855 | Crooke | 160/256 |
| 81,258 A | | 8/1868 | Jacob | 160/121.1 |
| 362,706 A | | 5/1887 | Bell | 160/121.1 |
| 530,079 A | * | 12/1894 | Mignot et al. | 160/29 |
| 674,854 A | | 5/1901 | Crocker | 160/265 |
| 703,378 A | | 7/1902 | Blaustein | 160/256 |
| 810,278 A | | 1/1906 | Hopkins | 160/277 |
| 850,578 A | * | 4/1907 | Hitt | 160/250 |
| 1,003,045 A | | 9/1911 | Hartsough | 160/121.1 |
| 1,439,540 A | | 12/1922 | Forster | 160/265 |
| 2,110,938 A | | 3/1938 | Nutt | 118/211 |
| 3,192,991 A | | 7/1965 | Anderle | 160/167 R |
| 3,465,806 A | | 9/1969 | Sulkes | 160/84.06 |
| 5,419,385 A | | 5/1995 | Vogel et al. | 160/121.1 |
| 6,401,794 B1 | * | 6/2002 | Hamilton | 160/243 |

FOREIGN PATENT DOCUMENTS

| | | |
|---|---|---|
| DE | 201 17 865 U | 2/2002 |
| EP | 0 529 591 | 3/1993 |

* cited by examiner

*Primary Examiner*—David Purol
(74) *Attorney, Agent, or Firm*—Dorsey & Whitney LLP

(57) ABSTRACT

A covering for an architectural opening includes a head rail, a bottom rail with a take-up roller therein and an intermediate rail with both the intermediate rail and bottom rail suspended from the head rail, a fabric material interconnecting the intermediate rail with the bottom rail and being adapted to be wrapped around the roller in the bottom rail, said fabric including a pair of vertically oriented sheets that are horizontally spaced by a plurality of vertically spaced horizontal vanes with the vanes being movable between open and closed positions by opposite vertical movement of the sheets of material. A first control system is provided for raising and lowering the bottom rail and a second control system for raising and lowering the intermediate rail as well as tilting the intermediate rail to effect an opening or closing of the vanes.

10 Claims, 13 Drawing Sheets

BOTTOM-UP/TOP-DOWN RETRACTABLE CELLULAR SHADE

CROSS-REFERENCE TO RELATED APPLICATIONS

This application claims the benefit of U.S. Provisional Application No. 60/366,286, filed 20 Mar. 2002, which application is hereby incorporated by reference as if fully disclosed herein.

BACKGROUND OF THE INVENTION

1. Field of the Invention

This invention relates generally to retractable coverings for architectural openings or the like that include a pair of vertically oriented sheets horizontally spaced by a plurality of vertically spaced horizontally extending vanes. Oppositely directed vertical movement of the sheets causes the vanes to pivot about horizontal longitudinal axes between open and closed positions. In the open position, the vanes are horizontally disposed defining a gap therebetween permitting the passage of vision and light, and in a closed position, the vanes are substantially vertically oriented and overlap slightly to block the passage of vision and light there through. The coverings are retractable by lifting a bottom rail or lowering an intermediate causing the sheets of material and interconnected vanes to wrap around a horizontal roller. More specifically the present invention relates to a covering of the above-noted type wherein the top of the covering can be lowered or the bottom raised and the vanes opened or closed at any relative position of the bottom rail with respect to the top of the covering.

2. Description of the Relevant Art

Coverings for architectural openings such as windows, doors, archways and the like, have taken numerous forms over many years. Early simple forms of such coverings amounted to fabric draped or otherwise suspended across an opening while in recent years more sophisticated coverings have been developed.

By way of example, venetian blinds have become a popular form of coverings for architectural openings wherein a plurality of vertically spaced, horizontally extending slats are pivotally supported by cord ladders so that the slats can be pivoted or tilted about horizontal longitudinal axes to move the covering between open and closed positions or the slats can be gathered into a vertical stack adjacent the top of the architectural opening in a retracted condition of the covering.

More recently such venetian blinds have been designed so as to not only retract vertically by lifting a bottom rail toward the headrail of the covering but by also dropping a top rail toward the bottom rail and such coverings are commonly referred to as bottom-up/top-down coverings. As will be appreciated, in a bottom-up/top-down covering, the slats can be gathered adjacent to the top of the opening or the bottom of the opening and can further be tilted at intermediate locations to permit or prevent the passage of vision and light therethrough.

More modern coverings for architectural openings have been referred to as cellular coverings wherein a plurality of horizontally extending, vertically stacked cells can be extended across an opening or gathered adjacent an edge of the opening in a stacked condition with the cells collapsed adjacent to each other. One disadvantage with this type of cellular covering resides in the fact that when the covering is extended across an opening, vision and light are blocked.

To overcome the shortcomings in the afore-noted cellular-type coverings, a new version of a cellular covering includes a pair of parallel vertically disposed sheets of sheer-type fabric which are normally suspended in horizontally-spaced relationship and include a plurality of vertically spaced horizontally extending vanes, which may be flexible, extending therebetween. By moving the sheets in opposite vertical directions, the vanes can be moved between open and closed positions so that in an open position, the vanes are disposed substantially horizontally to permit the passage of vision and light therebetween, and in a closed position, are disposed substantially vertically and overlap to block the passage of vision and light. Of course, in the closed position, the sheets of sheer material are disposed closely adjacent to each other with only the vanes separating the sheets. This type of cellular shade is moved from an extended position, wherein it extends across the architectural opening, to a retracted position by rolling the two sheets with the vanes therebetween about a roller disposed in the headrail at the top of the opening. Of course, to extend the covering across the opening, the roller is simply rotated in the opposite direction and a weighted bottom rail pulls the sheet material with the vanes secured thereto downwardly by gravity. Such coverings to date have only been operable by drawing the bottom rail upwardly and rolling the fabric material, comprised of the sheets and vanes, about a roller within the head rail.

More versatility in cellular coverings of this latter type would be desirable and it is to that end that the present invention has been developed.

SUMMARY OF THE INVENTION

A cellular covering for architectural openings in accordance with the present invention includes a head rail, a bottom rail, and an intermediate or mid rail with a fabric structure secured to and extending between the intermediate rail and the bottom rail. The fabric structure includes front and rear sheet materials adapted to be suspended vertically and with a plurality of vertically spaced horizontally extending vanes interconnecting the two sheets. The vanes are preferably flexible, even though this is not a requirement, and are of a width and spacing such that when vertically oriented, will overlap each other. When horizontally oriented, the vanes define spaces therebetween through which light and vision can pass.

The bottom rail includes a roller about which the fabric material can be selectively wrapped or unwrapped. The bottom rail is suspended from the headrail by a first control system that is manually operated so that the bottom rail can be selectively raised toward the top rail and positioned at any location between its lowermost position, which it assumes when the covering is fully extended, and a retracted position adjacent the headrail when the covering is fully retracted. The roller in the bottom rail around which the fabric structure can be wrapped and unwrapped is spring biased. The bias is in a direction so as to encourage wrapping of the fabric structure about the roller when the fabric structure is fed into the bottom rail as when the bottom rail is raised or the intermediate rail is lowered. When the bottom rail is lowered or moved by gravity away from the headrail causing the fabric structure to unroll from the roller, the weight of the bottom roil is sufficient to allow the fabric to unwind from the roller against the bias of the spring in the roller.

The intermediate rail is also suspended from the headrail and is adapted to be manipulated by a second control system which allows the intermediate rail, to which the upper edge of the fabric structure is secured, to move upwardly or downwardly. When moving the intermediate rail downwardly from the head rail, the fabric structure is shifted downwardly away from the head rail and fed into the bottom rail where it is wrapped around the roller within the bottom rail due to the bias of the roller encouraging the fabric to be wrapped therearound. The intermediate rail can be positioned at any location between the head rail and the bottom rail so as to define a gap between the intermediate rail and the head rail where there would be no fabric material.

The intermediate rail can also be pivoted about a horizontal longitudinal axis by the second control system such that the front and rear sheets of material are shifted in a opposite vertical directions thereby causing the horizontal vanes to shift between an open substantially horizontal position, permitting the passage of vision and light therebetween, and a closed substantially vertical position, wherein the vanes overlap and block vision and light therethrough.

It will be appreciated that the covering of the present invention is a bottom-up/top-down covering with the bottom rail and intermediate rail being movably positionable anywhere in between their extreme lower and upper positions so that the fabric structure between the bottom rail and the intermediate rail can be extended to any desirable degree and positioned at any location across the opening.

Other aspects, features, and details of the present invention can be more completely understood by reference to the following detailed description of a preferred embodiment, taken in conjunction with the drawings and from the appended claims.

DETAILED DESCRIPTION OF THE INVENTION

Figure 1:
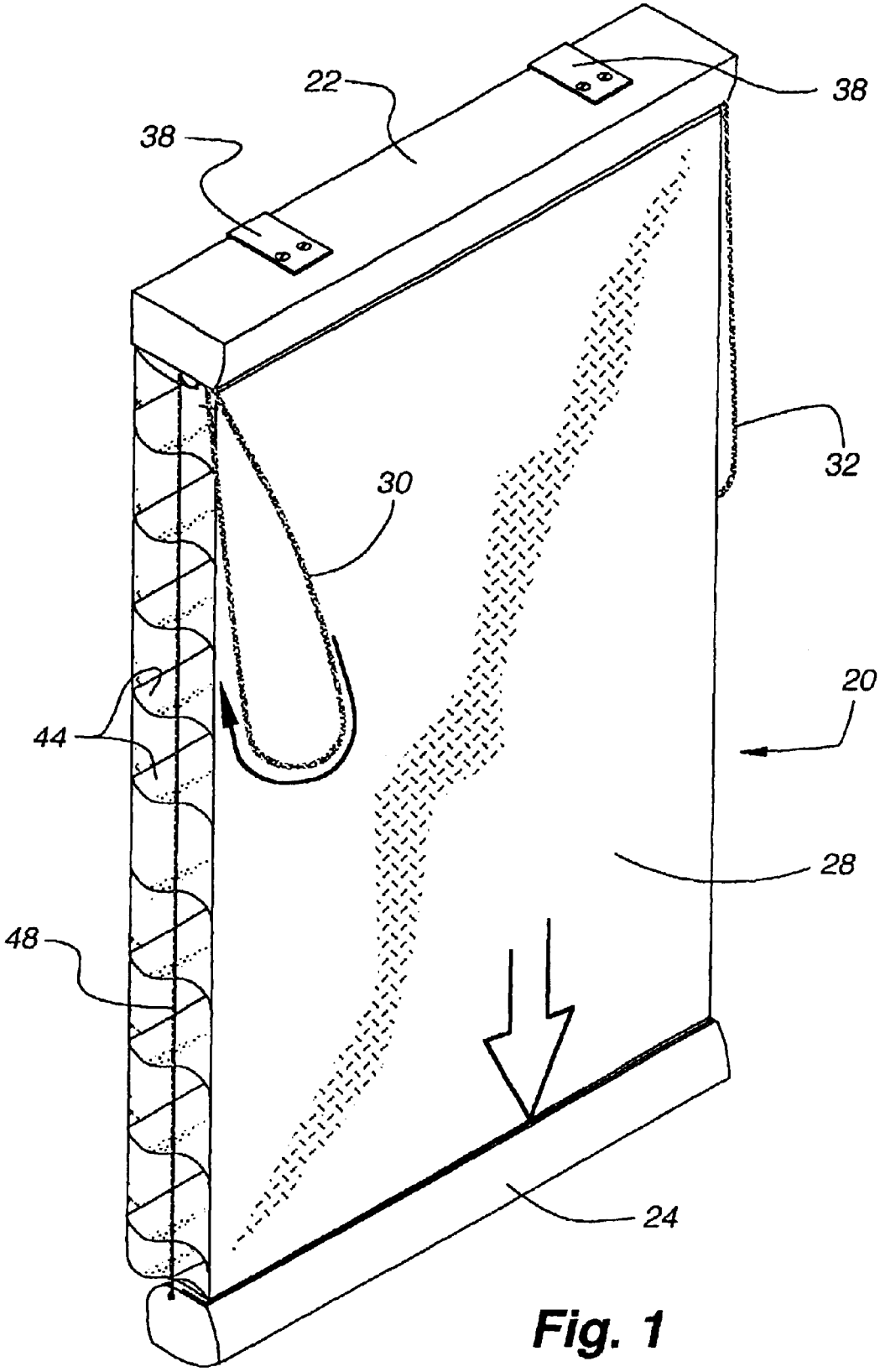
FIG. 1 is an isometric view of the covering of the present invention in a fully extended condition with the vanes open.

A covering 20 in accordance with the present invention is shown in FIG. 1 to include a head rail 22, a bottom rail 24, an intermediate rail 26, a flexible fabric material or structure 28 extending between the intermediate rail and the bottom rail and operating cords 30 and 32 for operating first 34 and second 36 control systems, respectively (FIGS. 9–12) for the covering. The first control system 34 enables movement of the bottom rail vertically between a fully retracted condition of the covering as shown, for example, in FIG. 12, and a fully extended condition as shown in FIG. 1. The second control system 36 is utilized to not only tilt the intermediate rail for purposes to be described later, but to also move the intermediate rail vertically between the fully retracted position of FIG. 1 and a fully extended position (not shown) wherein the intermediate rail is positioned adjacent to the bottom rail when the bottom rail is in its fully extended position of FIG. 1. Both control systems are adapted to removably position the associated intermediate or bottom rail at any position between the fully retracted and extended positions.

The head rail 22 includes a pair of brackets 38 adapted to mount the head rail to the frame or another location adjacent to an architectural opening, such as a window, door, archway, or the like.

The fabric material 28 that extends between the intermediate rail 26 and the bottom rail 24 is comprised of front 40 and rear 42 flexible sheets of material such as sheer fabric, with the sheets being suspended from the intermediate rail in a horizontally spaced, vertically oriented condition when the fabric is fully extended as illustrated in FIG. 1. A plurality of vertically spaced, horizontally disposed vanes 44 extend between and are operatively connected to the sheets of material and while the vanes could assume different structures, in the preferred embodiment, they too are a flexible fabric material which may be the same or different than the material from which the sheets are made. Preferably, the vanes are opaque or translucent while the sheet material is transparent or translucent.

As will be appreciated with the operation of the covering to be described later, the fabric 28 is movable by the intermediate rail 26 between an open position illustrated in FIG. 1 and a closed position illustrated in FIG. 11. In the open position, the vanes 44 can be seen to assume a substantially S-shaped cross sectional configuration and are disposed substantially horizontally so as to define a space between adjacent vanes. This permits the passage of vision and light between the vanes and since the sheet materials 40 and 42 along the opposite side edges of the vanes are transparent or translucent, some degree of, light and vision is permitted through the fabric material when the covering is in the open condition of FIG. 1.

Figure 11:
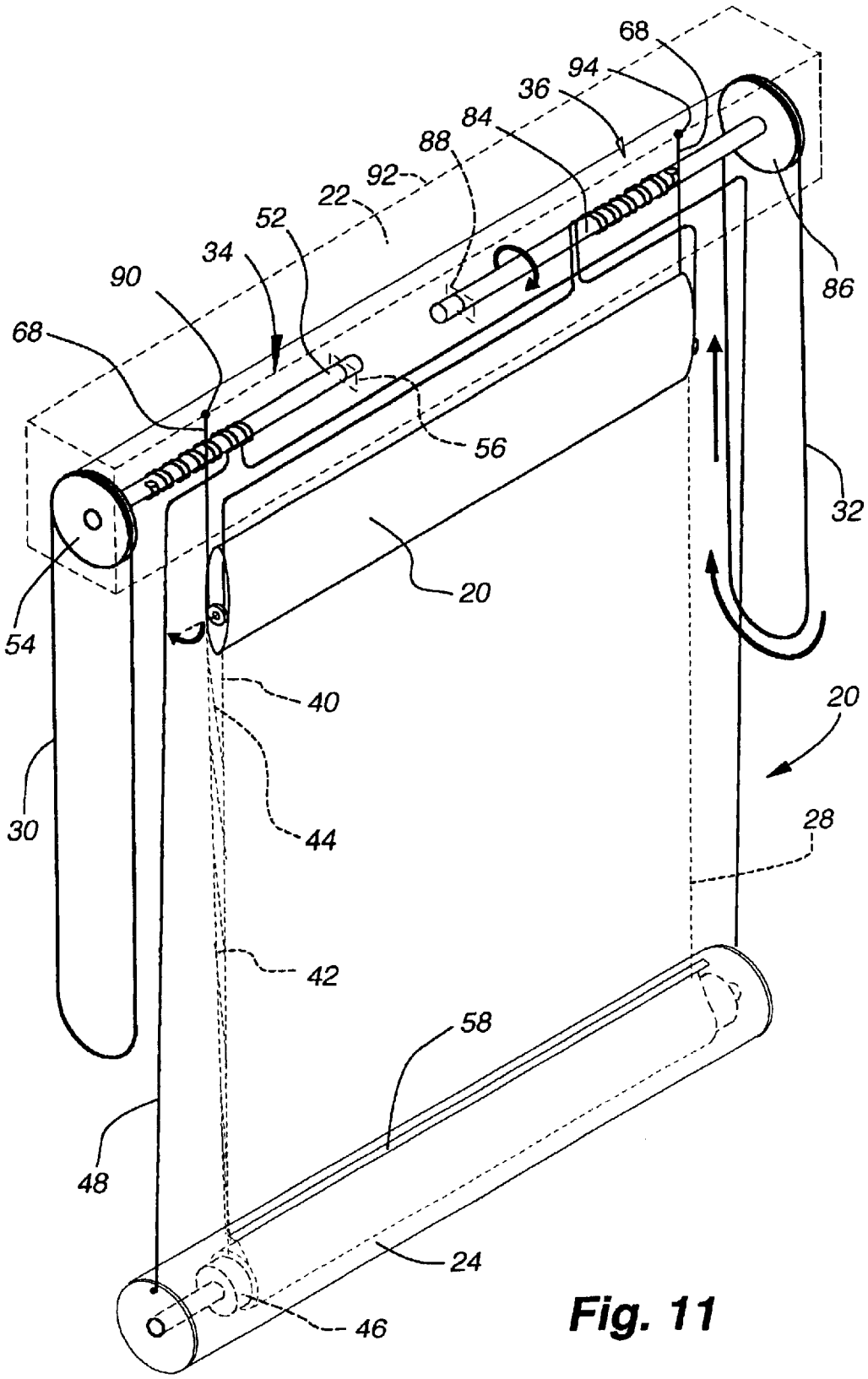
FIG. 11 is a diagrammatic isometric view similar to FIG. 9 with the vanes closed rather than open.
Figure 12:
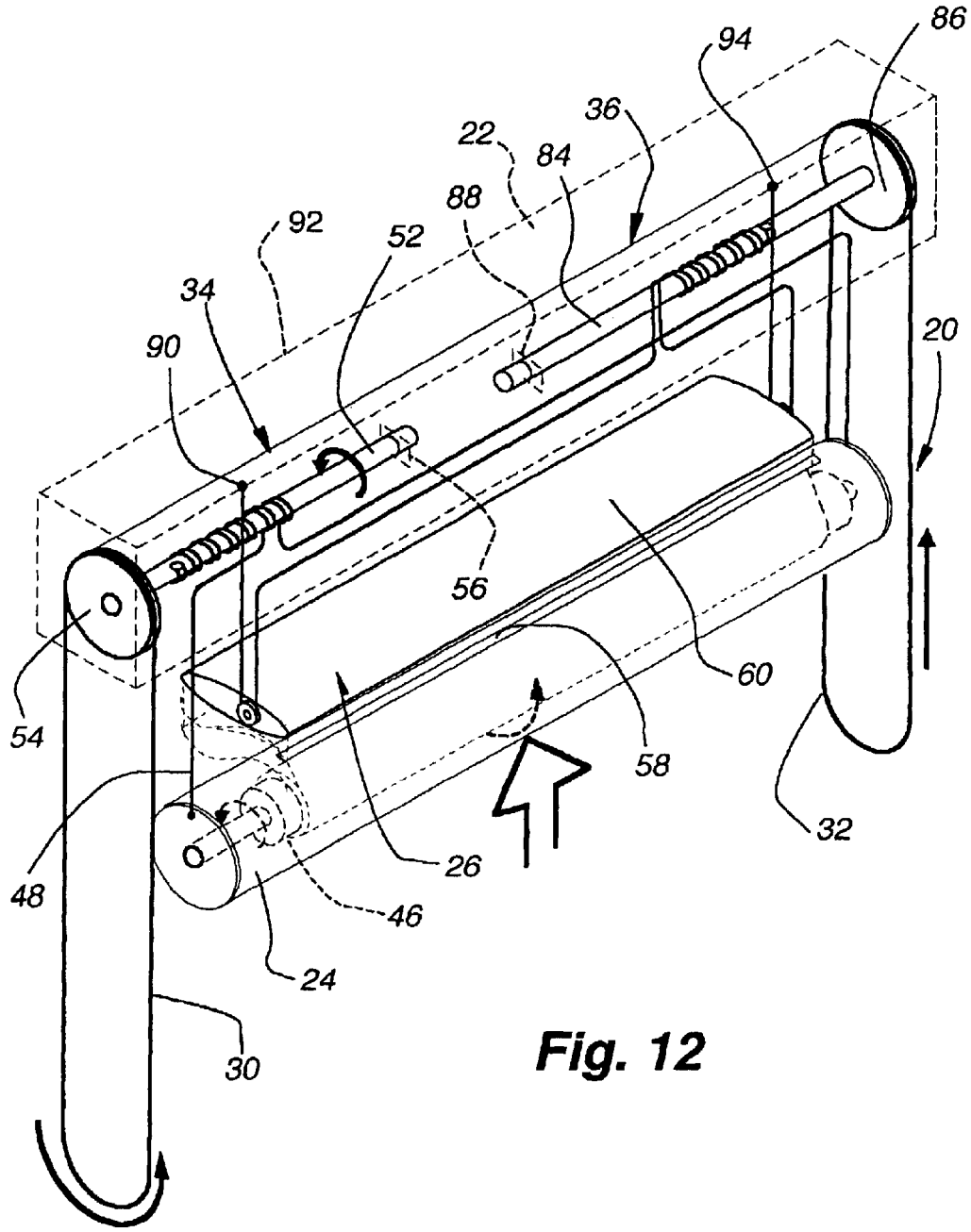
FIG. 12 is a diagrammatic isometric view of the covering of the present invention with the bottom rail fully raised into a position adjacent to the intermediate rail.

In the closed condition of FIG. 11, the fabric sheets 40 and 42 have been shifted vertically in opposite directions relative to each other so that the vanes 44 assume a substantially flat vertical planar orientation with adjacent vanes slightly overlapping to block, at least to some degree, the passage of vision and light through the fabric. Accordingly, the covering is movable between open and closed conditions by shifting the fabric sheets 40 and 42 in opposite vertical directions relative to each other as will be explained in more detail later.

The bottom rail 24, as best seen in FIGS. 5–12, includes an elongated rotable roller or roll bar 46 about which the fabric 28 can be wrapped or unwrapped with the roll bar being biased in a clockwise direction (as viewed in the drawings) by a conventional internal roller spring (not seen). The strength of the roller spring is determined by factors, which will become more apparent hereafter.

The first control system 34 shown at the left end of the covering 20 includes a pair of elongated flexible lift cords 48 or the like which extend from the headrail 22 to the bottom rail 24 at opposite ends of the bottom rail and are adapted to be extended or retracted by the closed loop flexible operating cord 30 or the like suspended at the left end of the covering for ready access by an operator of the covering. As will be explained in more detail later, movement of the operating cord 30 in one direction or the other causes the bottom rail to lift or lower through a retraction or extension of the lift cord 48 at each end of the covering. Retraction of the lift cords causes the bottom rail 24 to rise while retaining its horizontal orientation and move towards the head rail 22. As the bottom rail rises toward the head rail, the bias on the spring roller in the bottom rail causes the fabric to be wrapped around the roller. As the fabric is wrapped around the roller, it antomatically moves the front and rear sheets of material 40 and 42 respectively toward each other in a manner to be described later thereby shifting the vanes 44 to a closed position so the vanes lie flat between the sheets of material as the fabric is wrapped about the roller.

As is probably seen best in FIGS. 9–12, the first control system 34 is mounted in the head rail 22 and includes a horizontal rod 52 supporting a pulley 54 at its left end and supported by a bearing 56 at its right end. The pulley 54 receives the endless operating cord 30 so that movement of the operating cord in one direction or the other causes a corresponding rotative movement of the pulley and the rod 52 which is fixed thereto for unitary movement therewith. The lift cords 48 associated with opposite ends of the bottom rail 24 are secured to the rod so as to be wrapped or unwrapped therefrom as the operating cord is moved.

Figure 2:
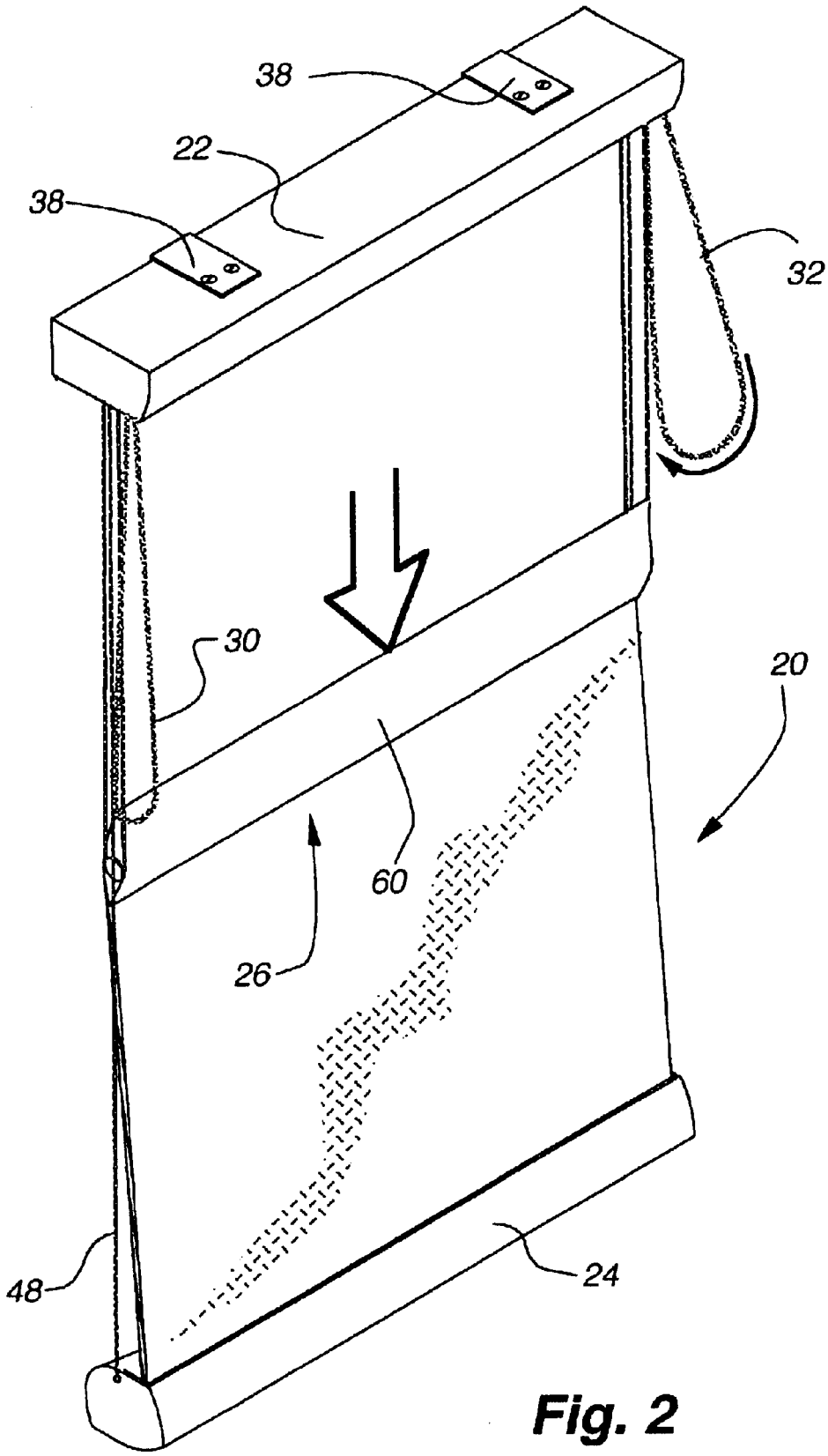
FIG. 2 is an isometric view of the covering of the present invention with the intermediate rail partially lowered and the vanes in a closed position.
Figure 3:
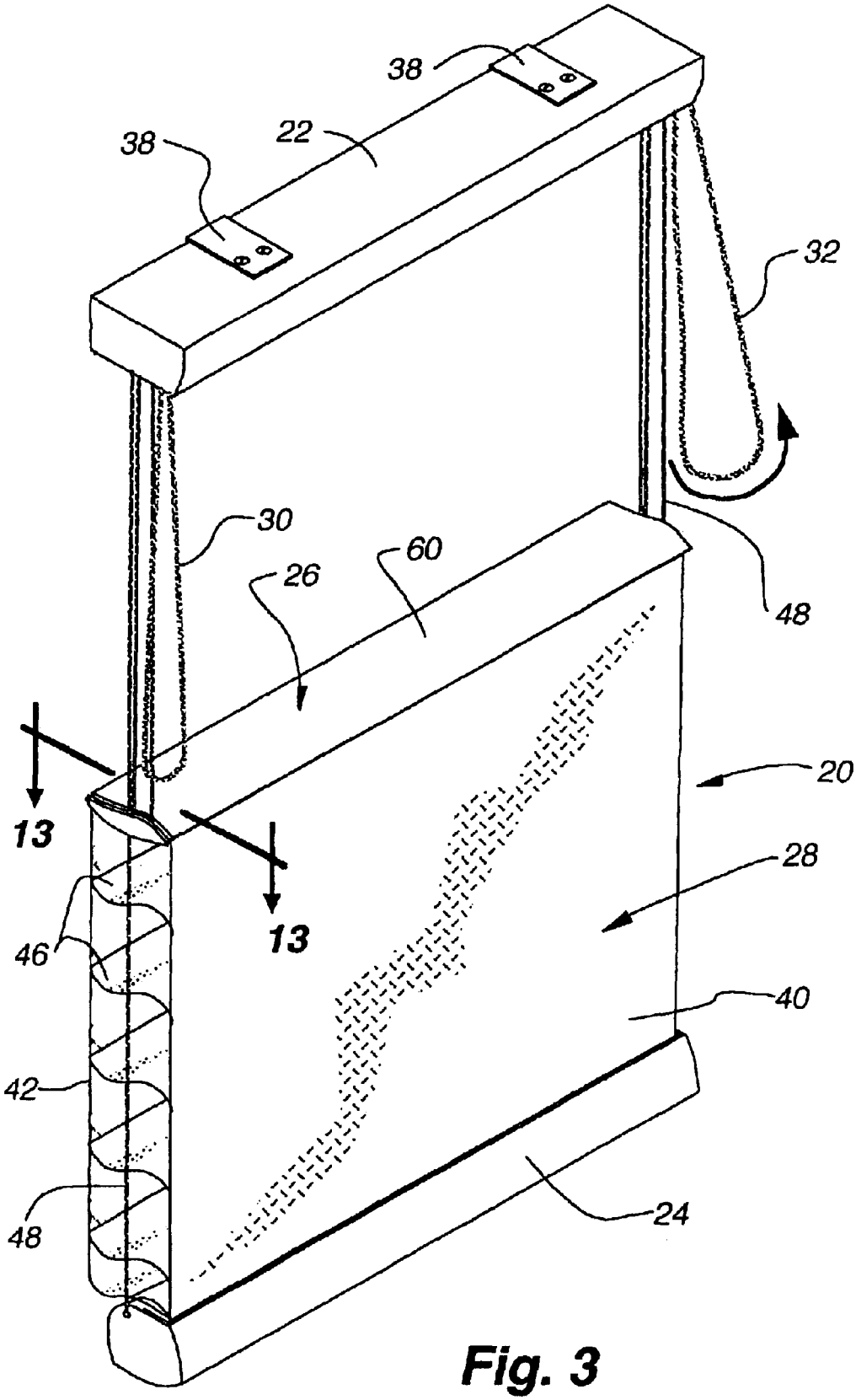
FIG. 3 is an isometric view of the covering of the present invention with the intermediate rail lowered and the vanes in an open position.

It will therefore be appreciated that if the bottom rail 24 is in the fully extended position of FIG. 1, for example, rotation of the rod 52 in a clockwise direction will cause the lift cords 48 at opposite ends of the bottom rail to be wrapped around the associated rod causing the bottom rail to rise in a horizontal orientation and as it rises, the spring bias in the roll bar 47 causes the fabric material 28 to accumulate and be wrapped around the roller. It does not matter whether or not the fabric is in the open position of FIG. 1 or the closed position of FIG. 2 when the bottom rail is lifted as the fabric is passed through a narrow slot 58 provided in the top surface of the bottom rail prior to being wrapped about the roll bar forcing the fabric sheets 40 and 42 together, while in the bottom rail but unaffecting the fabric when outside the bottom rail. When the operating cord 30 for the first control system is moved in a counterclockwise direction causing the rod 52 to rotate correspondingly, the lift cords are allowed to unwrap from the rod and the bottom rail moves downwardly under the force of gravity and against the bias of the roll bar spring so the fabric material is unrolled from the roll bar and allowed to slide outwardly through the narrow slot 58 into a deployed position between the intermediate rail 26 and the bottom rail 24. It will be appreciated that the strength of the spring in the roll bar 46 is sufficient to wrap the fabric therearound as the bottom rail is raised but not so strong as to prevent gravity from lowering the bottom rail as the lift cords are extended.

As will be appreciated by reference to FIGS. 9–17, the intermediate rail 26 has a relatively flat ovular main body 60 that is hollow in construction and has end caps 62 in opposite ends thereof. The end caps are rigid in nature and can be made of any suitable material such as plastic and serve partially to provide closure to the open ends of the ovular body. The ovular body needs to be somewhat rigid so as to support the fabric 28 and in particular, the front sheet 40 of the fabric is supported from the front edge 64 of the intermediate rail while the back sheet 42 of the fabric is supported from the rear or back edge 66 in a conventional manner.

Figure 13:
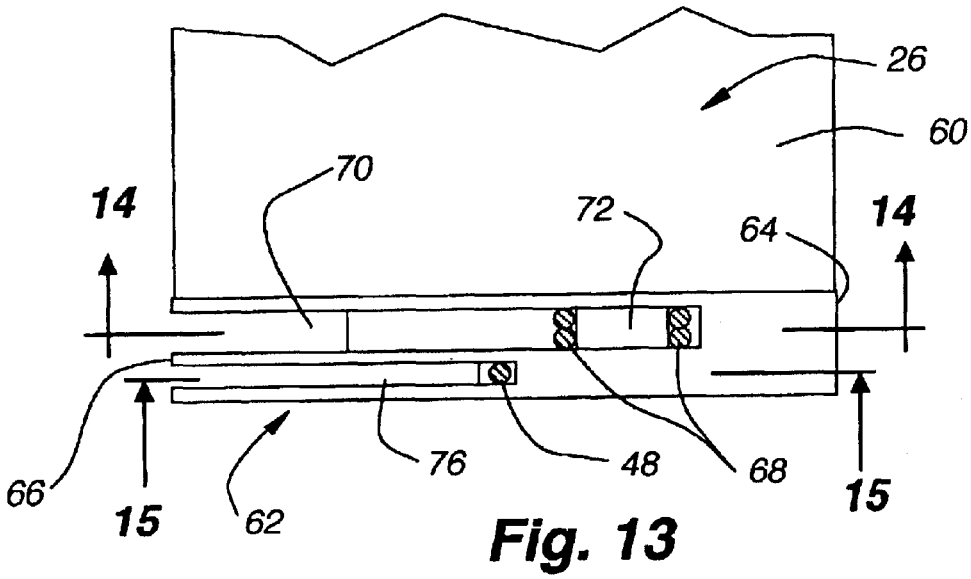
FIG. 13 is a fragmentary top plan view taken along Line 13—13 of FIG. 3 showing one end of the intermediate rail and an end cap mounted thereon.
Figure 14:
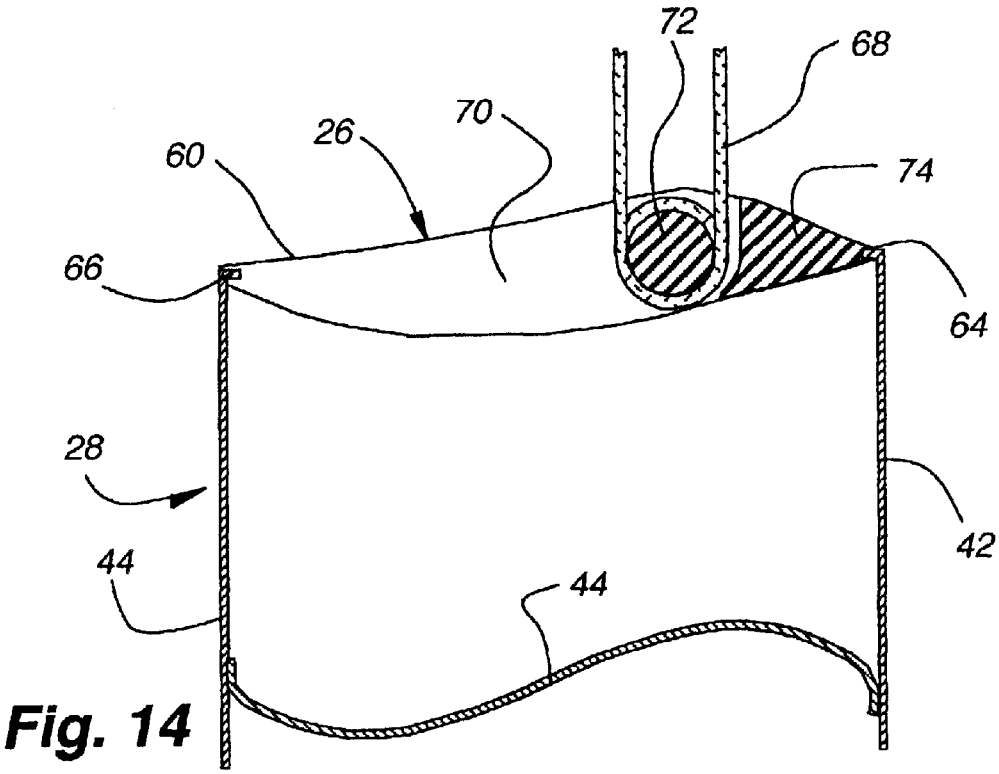
FIG. 14 is a fragmentary section taken along Line 14—14 of FIG. 13.

Each end cap 62 is provided with a plurality of slots formed transversely of the intermediate rail and adapted to receive the lift cords 46 for the bottom rail and tilt/lift cords 68 for the intermediate rail. The tilt/lift cords are part of the second control system 36 that will be described later. As seen in FIGS. 13 and 14, a first innermost slot 70 is formed from the rear edge 66 of the end cap and terminates at a location approximately ¾ of the way across the width of the end cap. The slot extends completely through the end cap from top to bottom. A wrap pin 72 is defined in the slot so as to extend from one side of the slot to the other adjacent to but slightly spaced from a block of material 74 defined adjacent to the front edge of the vane. The wrap pin 72 is adapted to receive the tilt/lift cord 68 in a manner such that the cord wraps around the pin twice for a purpose to be described later.

Figure 15:
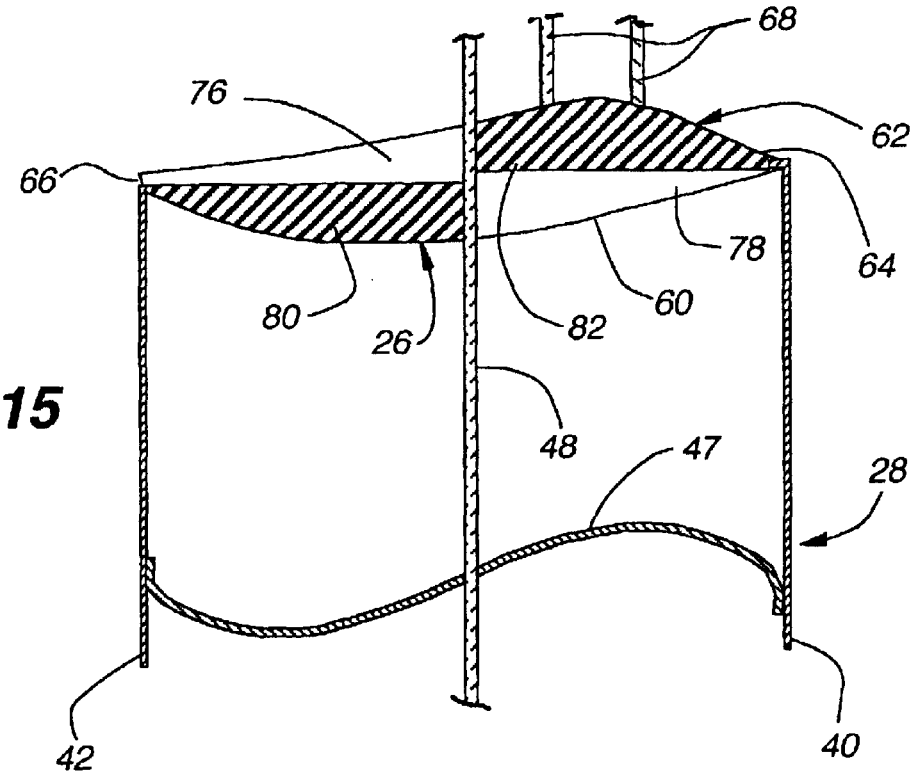
FIG. 15 is a fragmentary section taken along Line 15—15 of FIG. 13.
Figure 16:
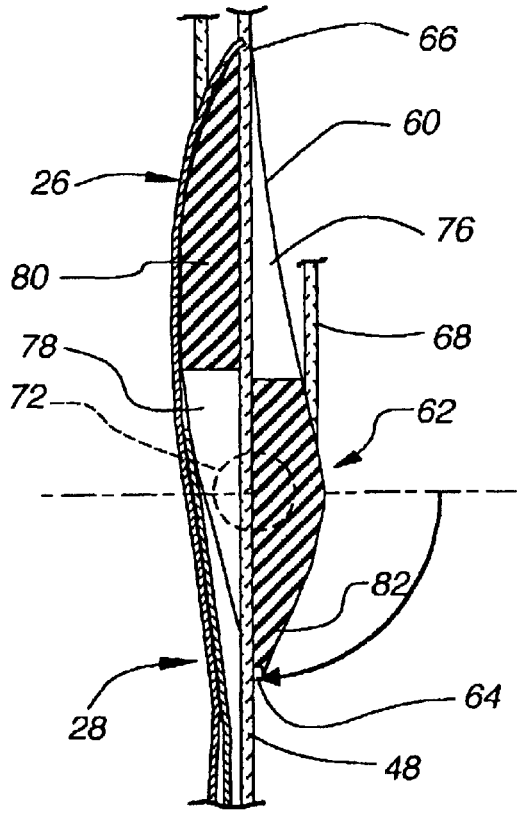
FIG. 16 is a fragmentary section similar to FIG. 15 with the intermediate rail rotated through 90°.
Figure 17:
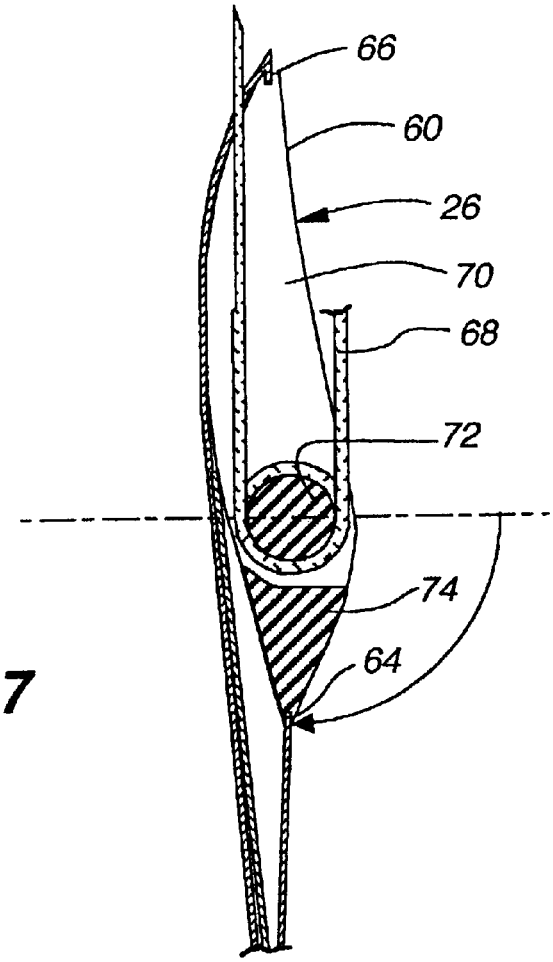
FIG. 17 is a fragmentary section similar to FIG. 14 with the vane having been rotated through 90°.
Figure 18:
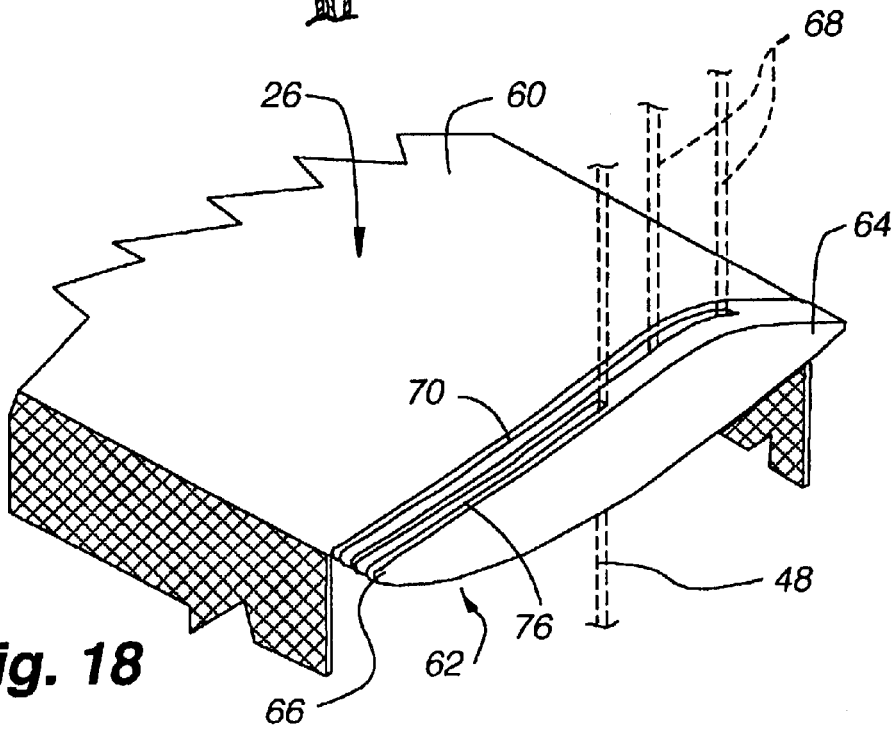
FIG. 18 is a fragmentary isometric looking at an end of the intermediate rail.

A second pair of aligned slots 76 and 78 are disposed outwardly from the innermost slot 70 as seen in FIGS. 13, 15, and 16. The slot 76 of the pair extends from the rear edge 66 of the end cap along the top half of the end cap slightly more than half the distance to the front edge 64 of the end cap while the second slot 78 of the pair extends from the front edge 64 of the end cap along the bottom half of the end cap to slightly past the center of the end cap. The associated lift cord 46 for the bottom rail 24 passes through the pair of slots 76 and 78 as best seen in FIGS. 13 and 15 so that when the intermediate rail 26 is horizontally disposed, there is a passage communicating with both slots 76 and 78 of the pair to accommodate the passage of the lift cord transversely through the slots. Further, when the intermediate rail is pivoted through 90° as shown in FIG. 16, the lift cord 46 again passes through the slots, this time longitudinally of the slots. It will be appreciated, however, that when the intermediate rail is horizontally disposed as shown in FIG. 15, the solid portions 80 and 82 of the end cap that are aligned with the slots 76 and 78 engage the lift cord and prevent the intermediate rail from pivoting in a counterclockwise direction while permitting pivotal movement in a clockwise direction until the intermediate rail becomes vertically oriented as shown in FIG. 16 where the lift cord again engages the solid portions, this time along different surfaces thereof, preventing further pivotal movement. When the vane is vertically oriented as in FIG. 16, of course, the vane can be pivoted in a counterclockwise direction but prevented from further pivotal movement in a clockwise direction.

As probably best appreciated by reference to FIGS. 9–12, the second control system 36 includes a horizontally disposed rod 84 carrying a pulley 86 at one end and is supported at its opposite end in a bearing 88 for rotative movement that is created by the second endless operating cord 32 operatively engaged with the pulley 86. Movement of the second operating cord in one direction or the other, therefore, causes the rod 84 to rotate in a corresponding direction. A pair of the flexible tilt/lift cords 68 are secured at one end to the rod 84 and are adapted to be wrapped around or unwrapped from the rod depending upon the direction of movement of the operating cord 32. One of the tilt/lift cords 68 extends from the rod 84 to the left end of the intermediate rail 26 where it extends downwardly and is wrapped twice around the associated wrap pin 72 in the end cap 62 before having the free end of the cord extend upwardly where it is anchored at 90 to a bottom surface of a top wall 92 of the head rail 22. The second tilt/lift cord 68 also extends from the rod 84 downwardly to the wrap pin in the end cap at the opposite end of the intermediate rail where it too is wrapped twice around the wrap pin and then extends upwardly where the end of the cord is secured at 94 to a bottom surface of the top wall 92 of the headrail.

The tilt/lift cords associated with the second control system extend along a front side of the associated wrap pin 72 before being wrapped therearound and extending upwardly from the rear side of the wrap pin toward their locations of anchor to the top wall 92. It will, therefore, be appreciated that as the tilt/lift cords are unrolled from the associated rod 84 by counterclockwise rotation of the operating cord 32, the tilt/lift cords become slack along the front edge of the wrap pins so that the wrap of cord about the wrap pins is loose enough to allow the intermediate rail 26 to drop by gravity. Before the intermediate rail drops vertically by gravity, however, it will pivot about a horizontal axis defined by the wrap pins 72 in a clockwise direction inasmuch as the end caps are designed to be heavier along the fronts edges 64 thereof. After the intermediate rail has pivoted through approximately 90 degrees (from the position of FIG. 15 to the position of FIG. 16), the lift cords 48 interact with the slots 76 and 78 in the associated end caps of the intermediate rail preventing further pivotal movement of the intermediate rail so that if the tilt/lift cords are continued to be unwrapped from the rod 84, the looseness of the wrap of the tilt/lift cords about the wrap pins allow the entire rail to drop by gravity while in its vertical orientation of FIG. 11.

The intermediate rail 26 can be lowered in the afore-noted manner from the fully retracted position of FIG. 11 to a fully extended position (not shown) adjacent to the bottom rail 24. This is true regardless of the location of the bottom rail, i.e. whether it is fully extended into its lowermost position or raised fully or partially into an intermediate location above the fully extended position.

However, if the operating cord 32 is moved in a clockwise direction, the tilt/lift cords 68 are caused to wrap about the rod 84 thereby tightening the wrap of the tilt/lift cords about the wrap pins and causing the intermediate rail to initially pivot in a counterclockwise direction causing the tilt/lift cords to switch from the positions shown in FIG. 16 to the position of FIG. 15. Once the intermediate rail pivots to the horizontal orientation of FIG. 15, the lift cords again operatively engage the end caps terminating the pivotal movement of the intermediate rail whereby further wrapping of the tilt/lift cords about the rod 84 shortens their effective length causing the intermediate rail to rise.

Figure 4:
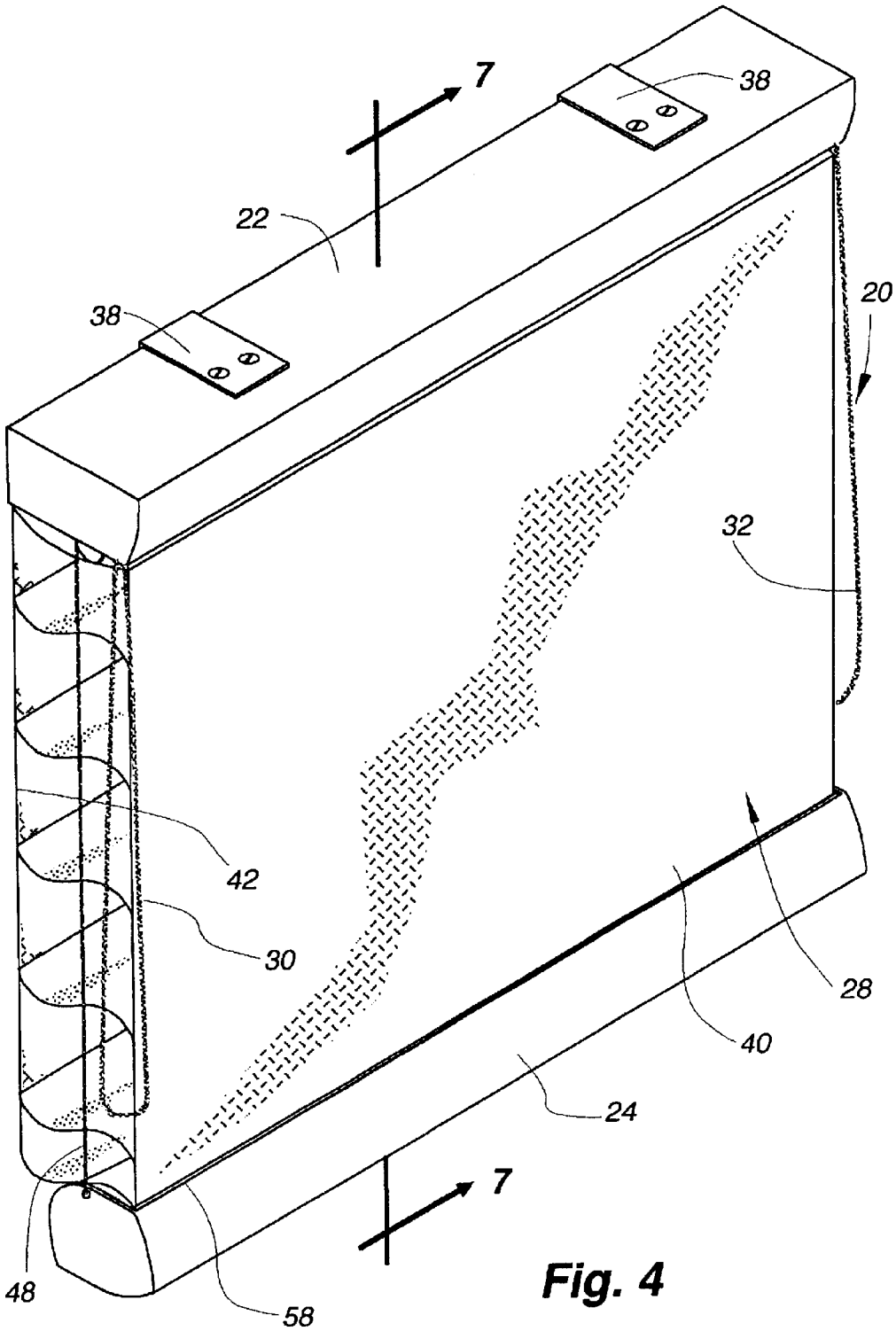
FIG. 4 is an enlarged isometric view of the covering of the present invention with the bottom rail partially raised and with the vanes in an open condition.
Figure 5:
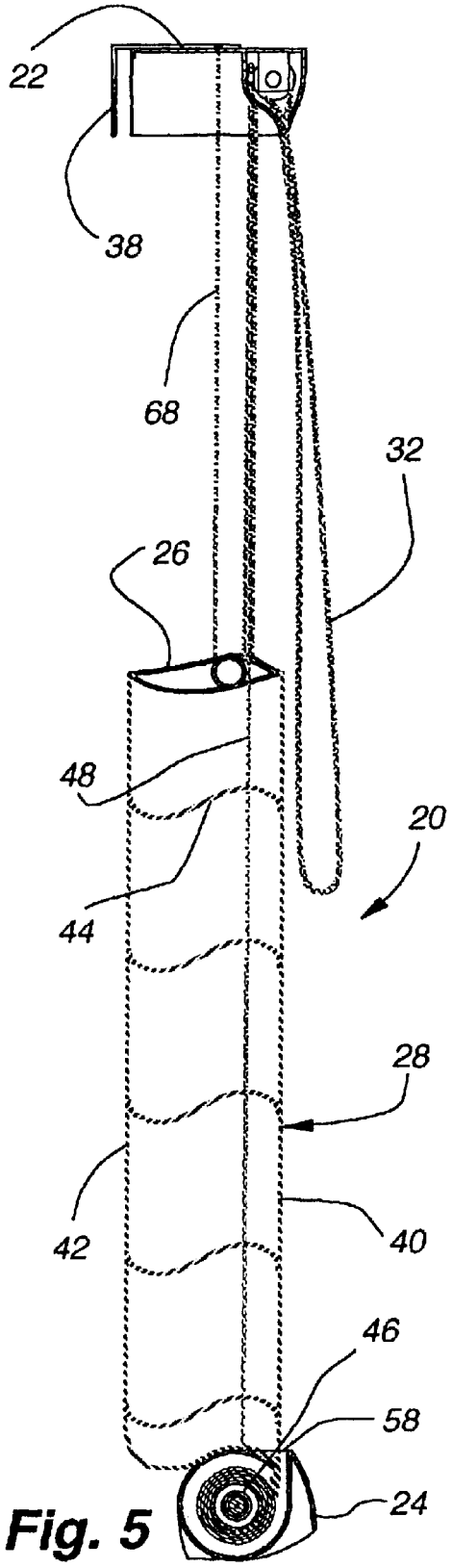
FIG. 5 is a vertical section taken through the covering of the present invention as seen in FIG. 3.
Figure 6:
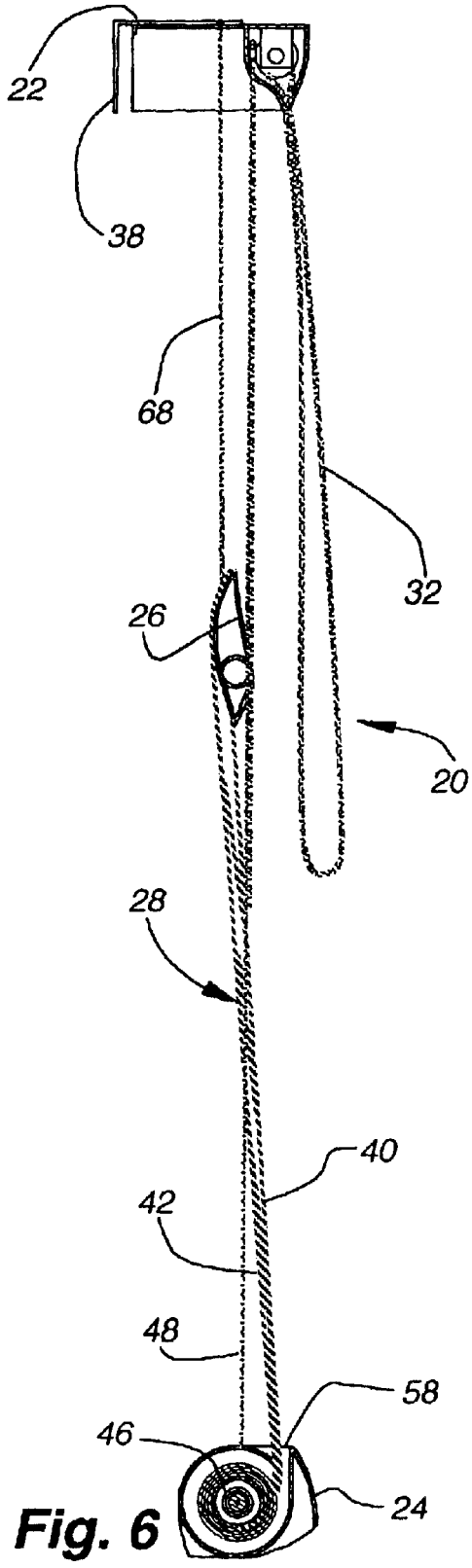
FIG. 6 is a vertical section taken through the covering of the present invention as seen in FIG. 2.
Figure 7:
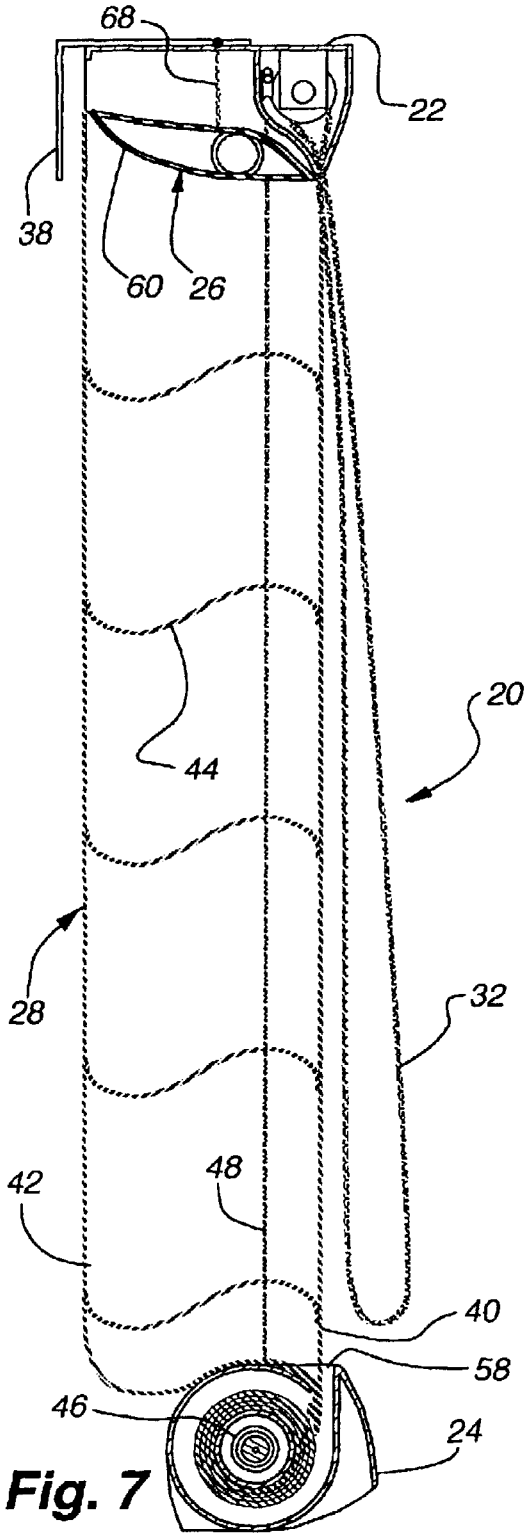
FIG. 7 is a vertical section taken along line 7—7 of FIG. 4.
Figure 10:
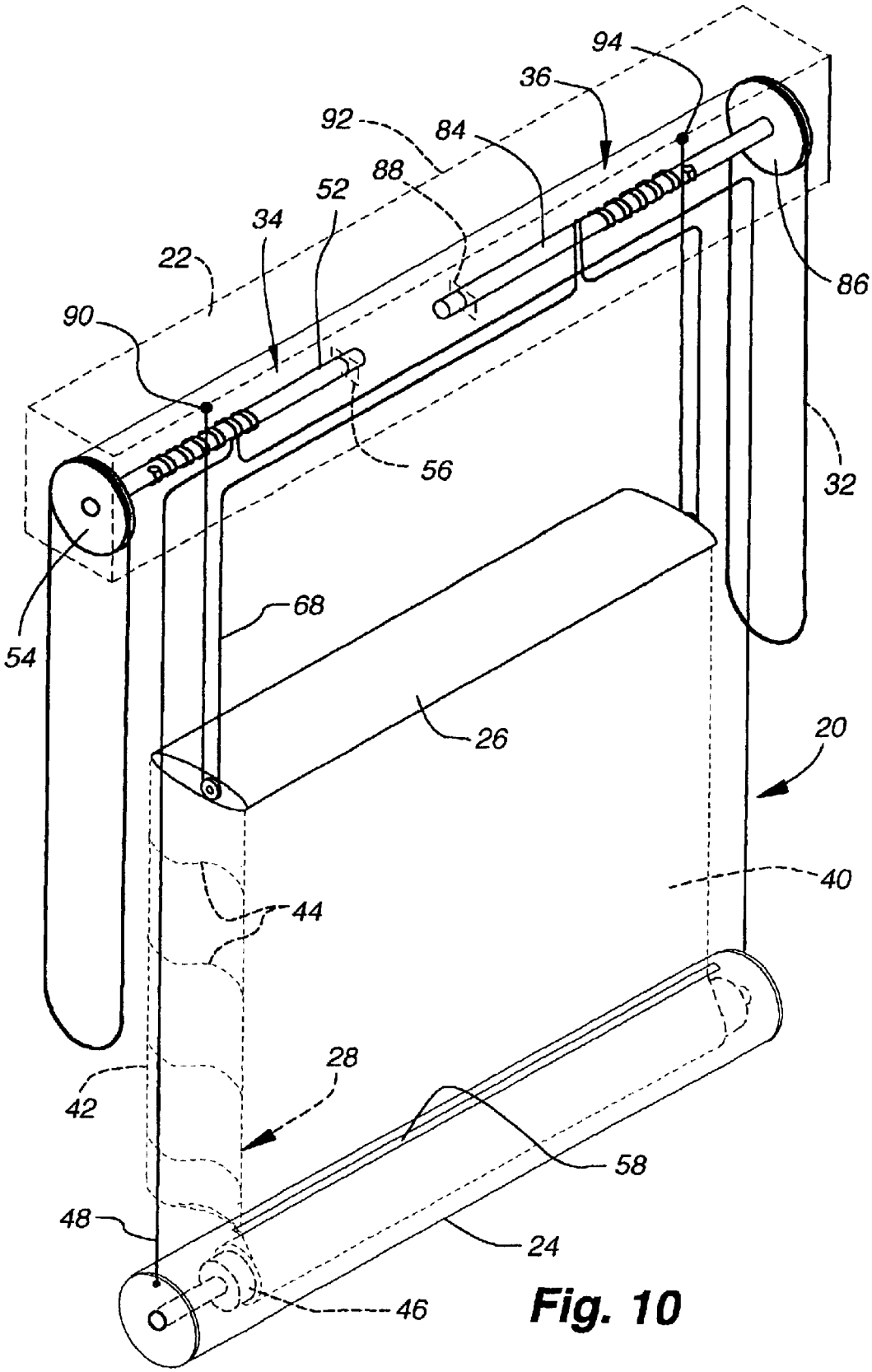
FIG. 10 is a diagrammatic isometric view similar to FIG. 9 with the intermediate vane partially lowered.

Clutches (not shown) are associated with both the first and second control systems 34 and 36 to permit the bottom rail 24 and the intermediate rail 26 to removably maintain any position between their fully extended and fully retracted positions so the fabric 28 extending therebetween can be extended fully across the architectural opening (FIG. 1), from the top partially down (FIG. 4), from the bottom partially up (FIG. 2). or to any degree there between across an intermediate portion of the opening (FIG. 10).

Figure 8:
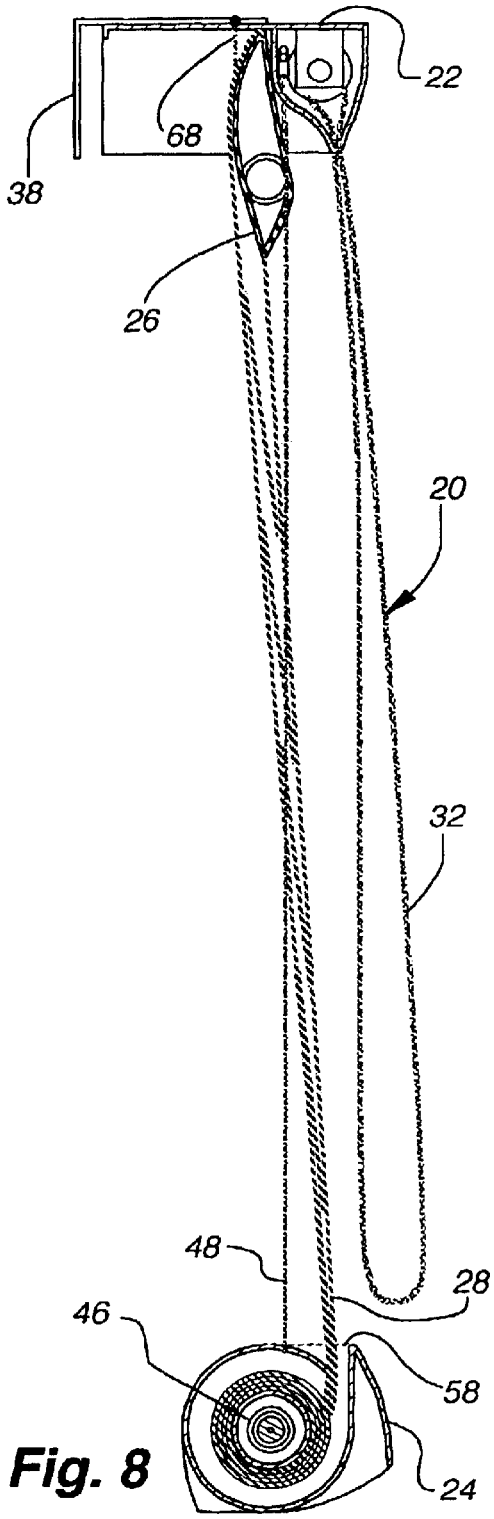
FIG. 8 is a section similar to FIG. 7 with the vanes in a closed rather than an open position.
Figure 9:
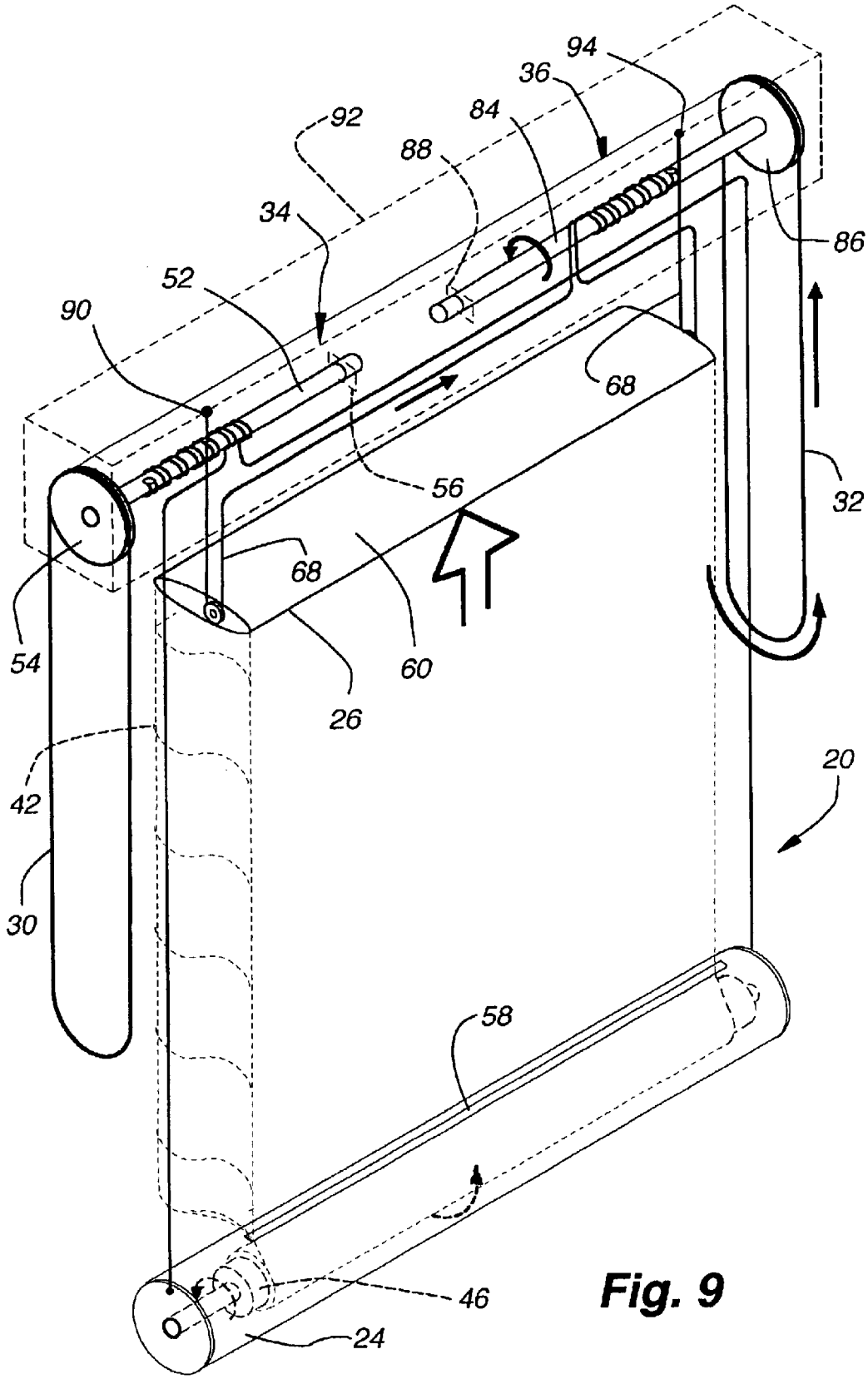
FIG. 9 is a diagrammatic isometric view showing the covering of the present invention in a fully extended position and with the vanes in an open position and further illustrating the control mechanisms for operating the covering.

It should also be appreciated that the intermediate rail 26 is designed and contoured to fit within the head rail 22 when the intermediate rail 26 is fully retracted regardless of whether or not the intermediate rail is horizontally oriented (FIG. 7) or vertically oriented (FIG. 8). This prohibits undesired light from passing between the head rail and intermediate rail when the intermediate rail is fully retracted.

Although the present invention has been described with a certain degree of particularity, it is understood that the present disclosure has been made by way of example, and changes in detail or structure may be made without departing from the spirit of the invention as defined in the appended claims.

What is claimed is:

1. A covering for an architectural opening comprising in combination:

a head rail, a bottom rail having a rotatable roller therein biased for rotation in a first direction, an intermediate rail movable vertically between said head rail and bottom rail, a flexible curtain disposed between said intermediate rail and said bottom rail, while being anchored along a top edge to said intermediate rail and to said roller along a bottom edge, a first control system for moving said bottom rail vertically, and a second control system for moving said intermediate rail vertically, whereby relative movement of said intermediate rail toward said bottom rail causes said flexible curtain to be wrapped around said roller and relative movement of said intermediate rail away from said bottom rail causes said flexible curtain to be unrolled from said roller.

2. The covering of claim 1 wherein said flexible curtain includes a plurality of elongated horizontally extending vanes, each vane being movable between open and closed orientations such that the transverse cross section of the vanes hang between being substantially horizontal in the open orientation and substantially vertical in the closed orientation, and wherein said intermediate rail is pivotally movable about a longitudinal axis to move said vanes between the open and closed orientations.

3. The covering of claim 2 wherein said pivotal movement of said intermediate rail is effected by said second control system.

4. The covering of claim 3 wherein said flexible curtain includes a pair of vertically extendable sheets and said vanes are secured to said sheets while being positioned between said sheets, wherein vertical movement of said sheets in opposite directions causes said vanes to move between said open and closed orientations and said pivotal movement of said intermediate rail causes said sheets to move vertically in opposite directions.

5. The covering of claim 4 wherein said intermediate rail has front and rear edges with the front edge being secured to one of said sheets and the rear edge to the other of said sheets.

6. The covering of claim 5 wherein said second control system includes an elongated flexible element operatively connected to said intermediate rail such that movement of said element in one direction causes the intermediate rail to pivot in a first direction and movement of said element in an opposite direction causes the intermediate rail to pivot in an opposite direction.

7. The covering of claim 6 wherein said second control system includes means for limiting the pivotal movement of said intermediate rail between first and second positions which are approximately 90° apart.

8. The covering of claim 7 wherein movement of said element of said second control system includes means for causing said intermediate rail to rise when said intermediate rail is in said first position and to fall when in said second position.

9. The covering of claim 8 wherein said means for limiting pivotal movement and said means for causing said intermediate rail to rise or fall include pins around which said element is wrapped and slots in said intermediate rail through which said element passes.

10. The covering of claim 4 wherein said bottom rail has a relatively narrow slot through which said flexible curtain passes for anchoring to said roller, such that the said sheets and vanes within said bottom rail are closely positioned for wrapping around said roller.

* * * * *